US008823762B2

(12) United States Patent
Yamazaki

(10) Patent No.: US 8,823,762 B2
(45) Date of Patent: Sep. 2, 2014

(54) IMAGE FORMING APPARATUS WITH SINUSOID-LIKE ADJUSTMENT OF LIGHT INCIDENT ON A ROTATING POLYGON MIRROR

(71) Applicant: Canon Kabushiki Kaisha, Tokyo (JP)

(72) Inventor: Katsuyuki Yamazaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/860,366

(22) Filed: Apr. 10, 2013

(65) Prior Publication Data

US 2013/0286142 A1 Oct. 31, 2013

(30) Foreign Application Priority Data

Apr. 26, 2012 (JP) ..... 2012-101485

(51) Int. Cl.

| | |
|---|---|
| ***B41J 2/435*** | (2006.01) |
| ***G03G 13/04*** | (2006.01) |
| ***G03G 15/043*** | (2006.01) |
| ***G03G 15/04*** | (2006.01) |

(52) U.S. Cl.

CPC ..... *G03G 13/04* (2013.01); *G03G 15/043* (2013.01); *G03G 15/04072* (2013.01)

USPC ..... 347/236; 347/246

(58) Field of Classification Search

USPC ..... 347/231, 236, 237, 243, 246, 247, 347/259–261

See application file for complete search history.

(56) References Cited

U.S. PATENT DOCUMENTS

| | | | | |
|---|---|---|---|---|
| 4,794,413 | A | 12/1988 | Yamazaki et al. | 346/160 |
| 5,095,371 | A * | 3/1992 | Tanaka et al. | 358/300 |
| 5,453,851 | A * | 9/1995 | Faulhaber | 358/481 |
| 6,078,347 | A * | 6/2000 | Nukui | 347/246 |
| 7,450,145 | B2 | 11/2008 | Yamazaki | 347/261 |
| 7,492,381 | B2 * | 2/2009 | Mizes et al. | 347/129 |
| 7,995,089 | B2 * | 8/2011 | Pepe | 347/261 |
| 2003/0063183 | A1 * | 4/2003 | AuYeung et al. | 347/246 |

FOREIGN PATENT DOCUMENTS

JP 2008-116664 5/2008

OTHER PUBLICATIONS

U.S. Appl. No. 13/859,593, filed Apr. 9, 2013; Inventor: Katsuyuki Yamazaki.

* cited by examiner

*Primary Examiner* — Hai C Pham

(74) *Attorney, Agent, or Firm* — Fitzpatrick, Cella, Harper & Scinto

(57) ABSTRACT

Density unevenness caused by an optical facet angle error or the like of a polygon mirror which has a plurality of reflection planes is corrected after shipment with a simple configuration. At least one of the plurality of reflection planes is identified as a reference plane. A plurality of pieces of light amount adjustment data for changing the light amount of light deflected for each reflection plane with the reference plane as a reference, and at least one piece of light amount correction data for correcting the light amount based on the plurality of pieces of light amount adjustment data are stored. When a light source emits light, one mode can be selected out of a test print mode (S5) in which light is emitted in a light amount based on the plurality of pieces of light amount adjustment data and a corrected print mode (S13) in which light based on the light amount correction data is emitted.

2 Claims, 16 Drawing Sheets

| ADDRESS | SPECIFICS |
|---|---|
| 0 | FACTORY MEASURED VALUE LIGHT AMOUNT CORRECTION DATA 1 |
| 1 | FACTORY MEASURED VALUE LIGHT AMOUNT CORRECTION DATA 2 |
| 2 | FACTORY MEASURED VALUE LIGHT AMOUNT CORRECTION DATA 3 |
| 3 | FACTORY MEASURED VALUE LIGHT AMOUNT CORRECTION DATA 4 |
| 4 | FACTORY MEASURED VALUE LIGHT AMOUNT CORRECTION DATA 5 |
| 5 | SINUSOIDAL AMPLITUDE A LIGHT AMOUNT CORRECTION DATA 1 |
| 6 | SINUSOIDAL AMPLITUDE A LIGHT AMOUNT CORRECTION DATA 2 |
| 7 | SINUSOIDAL AMPLITUDE A LIGHT AMOUNT CORRECTION DATA 3 |
| 8 | SINUSOIDAL AMPLITUDE A LIGHT AMOUNT CORRECTION DATA 4 |
| 9 | SINUSOIDAL AMPLITUDE A LIGHT AMOUNT CORRECTION DATA 5 |
| 10 | SINUSOIDAL AMPLITUDE B LIGHT AMOUNT CORRECTION DATA 1 |
| 11 | SINUSOIDAL AMPLITUDE B LIGHT AMOUNT CORRECTION DATA 2 |
| 12 | SINUSOIDAL AMPLITUDE B LIGHT AMOUNT CORRECTION DATA 3 |
| 13 | SINUSOIDAL AMPLITUDE B LIGHT AMOUNT CORRECTION DATA 4 |
| 14 | SINUSOIDAL AMPLITUDE B LIGHT AMOUNT CORRECTION DATA 5 |
| 15 | SINUSOIDAL AMPLITUDE C LIGHT AMOUNT CORRECTION DATA 1 |
| 16 | SINUSOIDAL AMPLITUDE C LIGHT AMOUNT CORRECTION DATA 2 |
| 17 | SINUSOIDAL AMPLITUDE C LIGHT AMOUNT CORRECTION DATA 3 |
| 18 | SINUSOIDAL AMPLITUDE C LIGHT AMOUNT CORRECTION DATA 4 |
| 19 | SINUSOIDAL AMPLITUDE C LIGHT AMOUNT CORRECTION DATA 5 |
| 20 | OPTICAL FACET ANGLE ERROR CORRECTION STATE |

FIG. 13

IMAGE FORMING APPARATUS WITH SINUSOID-LIKE ADJUSTMENT OF LIGHT INCIDENT ON A ROTATING POLYGON MIRROR

BACKGROUND OF THE INVENTION

1. Field of the Invention

The present invention relates to an image forming apparatus that uses a rotating polygon mirror having a plurality of reflection planes to deflect laser light with which a photoreceptor is exposed.

2. Description of the Related Art

Multi-lasers, which emit a plurality of laser beams have come to be used more and more often as image forming apparatus, are increasingly enhanced in speed and image quality. The enhancement of image forming apparatus in image quality is accomplished by raising image resolution to 1,200 dots per inch (dpi) or 2,400 dpi, raising gray scale gradient through the refining of multi-level expression, or the like.

On the other hand, raising resolution or gray scale gradient to enhance image quality makes band-like streaks, density unevenness, and the like in the sub-scanning direction, namely, banding, conspicuous. Banding is caused by, in addition to conveyance irregularities of a photoreceptor, a conveyer belt, or other components in a conveyance driving system, exposure unevenness due to a positional deviation in the sub-scanning direction as a result of an axial error in which the rotation axis of a polygon mirror in an exposure unit changes its position, or an optical facet angle error in which the tilt of a reflection plane of a polygon mirror with respect to the rotation axis of the polygon mirror changes. For instance, an axial error or optical facet angle error of a polygon mirror causes a positional deviation from an ideal spot in the sub-scanning direction for each reflection plane of the polygon mirror, and causes density unevenness in a cycle determined by the number of reflection planes of the polygon mirror.

As a solution to this, Japanese Patent Application Laid-open No. 2008-116664 has proposed a technology for an image forming apparatus in which image quality deterioration due to an optical facet angle error of a rotating polygon mirror is corrected by controlling the laser light amount. In this technology, each reflection plane of a polygon mirror is measured for the amount of an optical facet angle error at the time the image forming apparatus is assembled in a factory, and laser light amount correction data determined by the amount of the optical facet angle error is stored in a memory. The image forming apparatus identifies which reflection plane, out of the plurality of reflection planes of the polygon mirror, laser light enters, reads light amount correction data that is associated with the identified reflection plane out of the memory, and corrects the laser light amount based on the read correction data. Light amount correction data is generated to even out the sparseness/denseness of laser light scanning lines which is caused by an optical facet angle error. Specifically, when the scanning line interval from one reflection plane to another reflection plane is sparser than a given interval (resolution) due to an optical facet angle error, the laser light amount of at least one of the sparse scanning lines is increased and, when the scanning line interval from one reflection plane to another reflection plane is denser than the given interval due to an optical facet angle error, the laser light amount of at least one of the dense scanning lines is decreased. Adjusting the laser light amount in this manner makes density unevenness caused by an optical facet angle error less conspicuous. The amount of an optical facet angle error is measured with a high-precision measurement jig at the time a laser scanner is produced in mass, and light amount correction data generated based on the result of the measurement is recorded in a read only memory (ROM) or the like of the laser scanner. This light amount correction data is also used to correct the light amount when an image is actually formed.

However, the extent of an axial error, optical facet angle error, or the like of a polygon mirror can change after measurement due to an impact from an unforeseen accident after the product is shipped, or from the influence of temperature, humidity, and vibrations in the place where the product is installed. The extent can change also because of the aging of a motor shaft after shipment. In such cases, information measured and recorded in a ROM or the like in advance becomes useless and an effective correction cannot be made.

If banding worsens, the correction made ends up being an over-correction, or an appropriate correction can no longer be made, the laser scanner itself needs to be replaced. The resultant problem is that the cost of replacement parts and replacement work mounts.

The present invention has been made in view of the problems of the related art described above, and a main object of the present invention is therefore to provide an image forming apparatus configured to effectively correct, with a simple configuration, banding such as density unevenness due to an optical facet angle error or the like of a polygon mirror.

SUMMARY OF THE INVENTION

An image forming apparatus according to an exemplary embodiment of the present invention includes: a photoreceptor which forms an image in a manner determined by an amount of exposure; a light source which emits a light beam for exposing the photoreceptor; and a rotating polygon mirror for deflecting the light beam with a plurality of reflection planes so that the photoreceptor is scanned with the emitted light beam. The image forming apparatus also includes an identifying unit for identifying at least one of the plurality of reflection planes, as a reference plane. The image forming apparatus further includes a memory unit which stores a plurality of pieces of light amount adjustment data for changing a light amount of the light deflected for each of the plurality of reflection planes with the reference plane as a reference, and at least one piece of light amount correction data for correcting the light amount based on the plurality of pieces of light amount adjustment data. The image forming apparatus further includes a control unit which allows to choose one of a first mode for emitting light in an amount based on the plurality of pieces of light amount adjustment data and a second mode for emitting light based on the light amount correction data when the light is emitted from the light source.

The image forming apparatus of the present invention deflects light with the plurality of reflection planes so that light can be emitted in the first mode or the second mode to scan the photoreceptor. In the first mode, at least one of the plurality of reflection planes is identified as a reference plane, and the light amount of the light deflected for each reflection plane is changed with the use of the identified reference plane as a reference and with the use of a plurality of pieces of light amount adjustment data. In the second mode, which is the alternative to the first mode, the light amount of the light is changed with the use of at least one piece of light amount correction data for correcting the light amount based on the plurality of pieces of light amount adjustment data which are used in the first mode. By thus providing two modes to choose from, banding such as density unevenness due to, for example, an optical facet angle error of the polygon mirror, can be corrected effectively with a simple configuration.

Further features of the present invention will become apparent from the following description of exemplary embodiments (with reference to the attached drawings).

BRIEF DESCRIPTION OF THE DRAWINGS

FIG. 13 is a diagram illustrating an example of a profile that is recorded in a non-volatile memory.

DESCRIPTION OF THE EMBODIMENTS

An embodiment of the present invention is described below in detail with reference to the accompanying drawings.

First Embodiment

[The Configuration of an Image Forming Apparatus]

Figure 1:
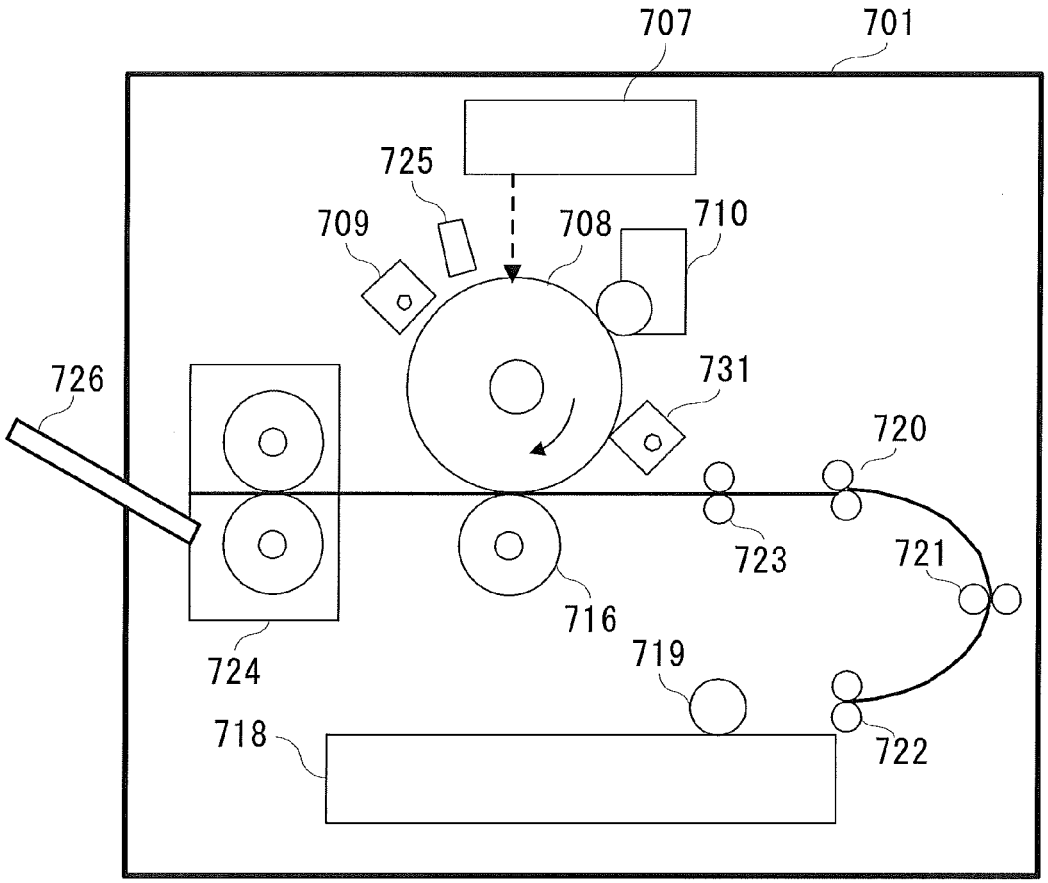
FIG. 1 is an overall configuration diagram of an image forming apparatus according to a first embodiment of the present invention.

FIG. 1 is an overall configuration diagram of an image forming apparatus according to a first embodiment of the present invention. The image forming apparatus, which is denoted by 701, forms an image under integrated control of a control unit which is built around a CPU and which is described later.

The image forming apparatus 701 includes a touch panel type operation unit through which various commands and data necessary for forming an image can be input. Image data is input to the image forming apparatus 701 via a personal computer (PC) or a network. Based on the image data input to the image forming apparatus 701, a photosensitive drum 708 (photoreceptor) whose surface has been charged with a charger 725 is exposed with laser light (a light beam) emitted from a laser scanner unit (hereinafter referred to as "LS unit") 707. An electrostatic latent image is formed on the photosensitive drum 708 exposed with the laser light. The electrostatic latent image is developed by a toner developing unit 710 to be turned into a toner image. A post-charger 731 charges a toner on the photosensitive drum 708 to align electric charges of the toner.

A recording medium such as sheets of printing paper is contained in a sheet cassette 718. The recording medium contained in the sheet cassette 718 is conveyed to a transferring unit by sheet conveying units 719, 720, 721, 722, and 723. A transfer unit 716 in the transferring unit applies bias to the recording medium, thereby transferring a toner image on the photosensitive drum 708 to the recording medium. The recording medium to which the toner image has been transferred passes through a fixing unit 724. The passing of the recording medium through the fixing unit 724 fixes the toner image transferred to the recording medium onto the recording medium. The recording medium onto which the toner image has been fixed is discharged to a sheet discharge tray 726. The toner remaining on the photosensitive drum 708 without being transferred to the recording medium is collected by a drum cleaner 709 in the transferring unit.

Figure 2A:
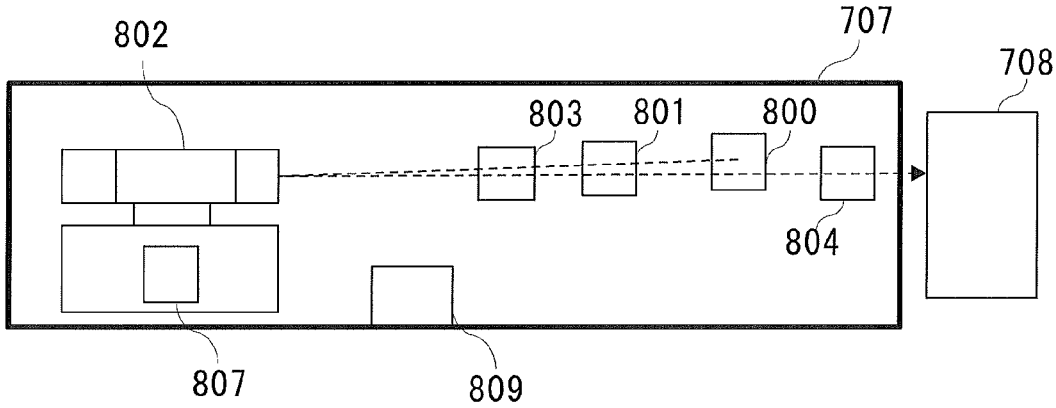
FIG. 2A is a schematic view viewed from a side of a light path of laser light.
Figure 2B:
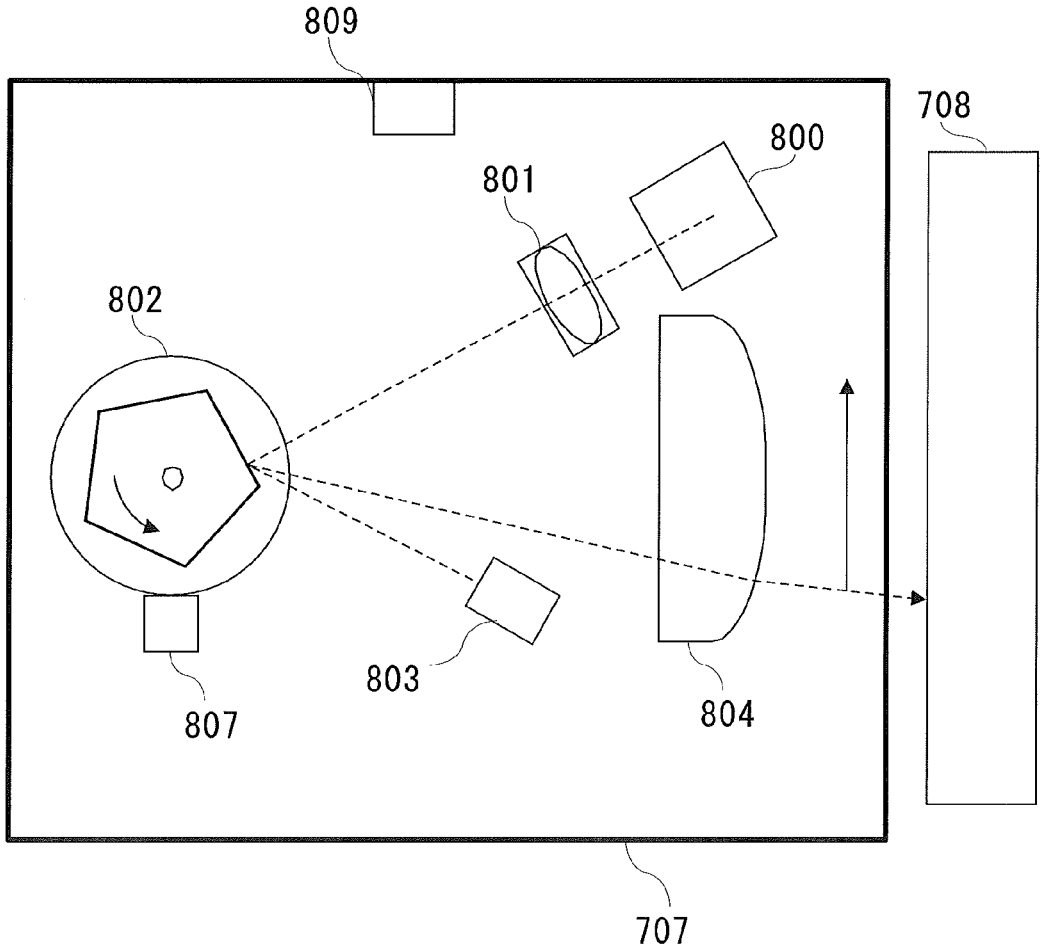
FIG. 2B is a schematic view viewed from above.

FIGS. 2A and 2B are schematic views of a light path of laser light that is used by the LS unit 707 to expose the photosensitive drum 708. FIG. 2A is a side view and FIG. 2B is a top view. The LS unit 707 emits laser light that has received APC light amount stabling control and light amount adjustment in a light emitting unit 800. Laser light emitted from the light emitting unit 800 is transmitted through a collimator lens 801 to be turned into collimated beams. The collimated beams are turned into scanning light when deflected by reflection planes of a polygon mirror 802, which has five reflection planes. The scanning light enters a beam detection (BD) sensor 803. The scanning light passes through an fθ lens 804 and then forms an image on the photosensitive drum 708. A DC brushless motor in which eight magnetic poles are formed for one rotation of the motor is used as a motor of the polygon mirror 802. The rotation of the magnetic poles of the DC brushless motor which drives the polygon mirror 802 to rotate the polygon mirror 802 is detected by an FG sensor 807 constituted of a Hall element. The LS unit 707 also has an electrically erasable programmable read-only memory (EEPROM) 809 built inside. The EEPROM 809 stores an initial profile for optical facet angle error correction which is calculated from a measurement made at the factory when the LS unit 707 is manufactured.

Figure 3:
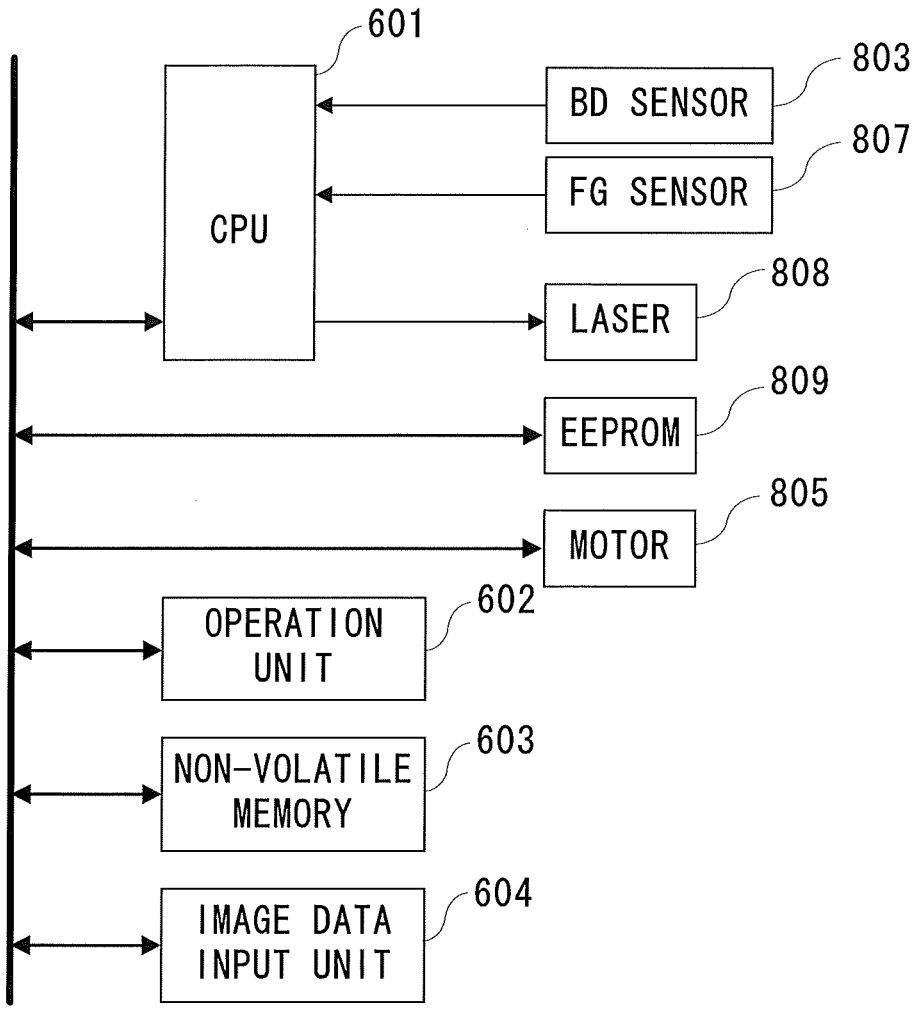
FIG. 3 is a configuration diagram of a control unit built inside the image forming apparatus.

FIG. 3 is a configuration diagram of the control unit included in the image forming apparatus 701. The control unit is built around a central processing unit (CPU) 601. An operation unit 602, a non-volatile memory 603, an image data input unit 604, a DC brushless motor 805 for driving the polygon mirror 802, and the EEPROM 809 are connected to the CPU 601 via a two-way communication bus. The BD sensor 803 and the FG sensor 807 are connected to input ports of the CPU 601.

The CPU 601 transmits image data modulated by PWM modulation to a laser light source 808, and the laser light source 808 emits laser light based on the image data.

The initial profile stored in the EEPROM 809 is five types of data in total which correspond to the five reflection planes of the polygon mirror 802. The initial profile is data indicating, for each of the plurality of reflection planes, the amount of an optical facet angle error with respect to the rotation axis of the reflection plane. The initial profile is read out of the EEPROM 809 by the CPU 601 provided in the main body of the image forming apparatus when the LS unit 707 is mounted to the image forming apparatus 701, and is copied to be kept in in the non-volatile memory 603 provided in the main body of the image forming apparatus. The CPU 601 reads the initial profile out of the non-volatile memory 603 onto an internal register array, and uses the read initial profile to correct the laser light amount when drawing an image or the like. The CPU 601 is configured so that accessing the non-volatile memory 603 is relatively easier for the CPU 601 than accessing the EEPROM 809. Copying the initial profile from the EEPROM 809 to the non-volatile memory 603 therefore improves software performance and hardware performance.

Figure 4A:
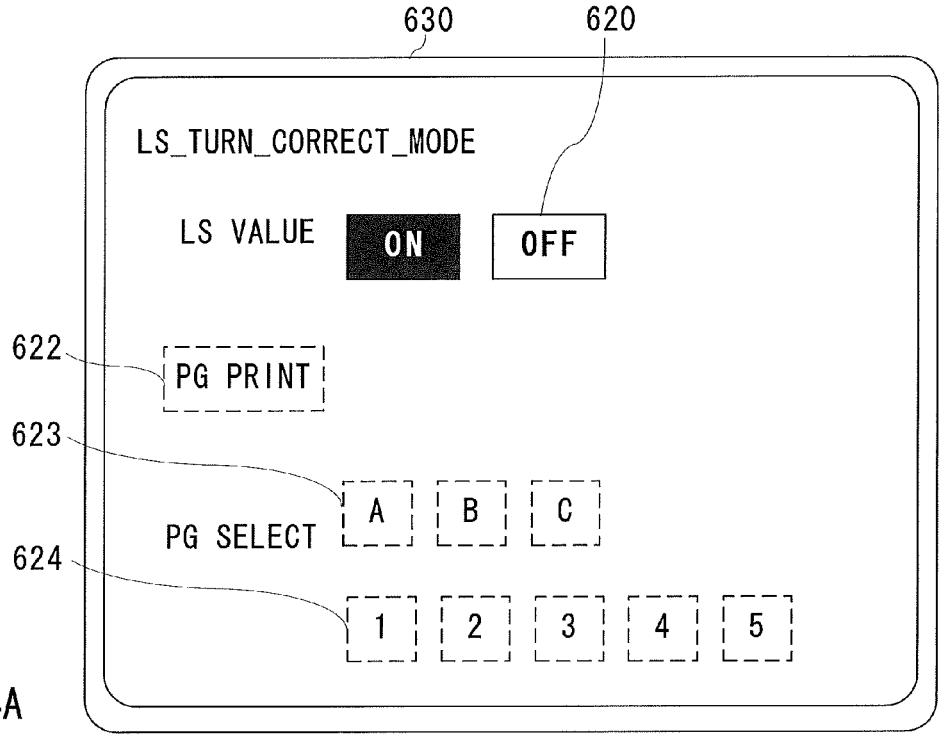
FIGS. 4A and 4B are diagrams illustrating how an input screen of an operation unit looks in optical facet angle error control.
Figure 4B:
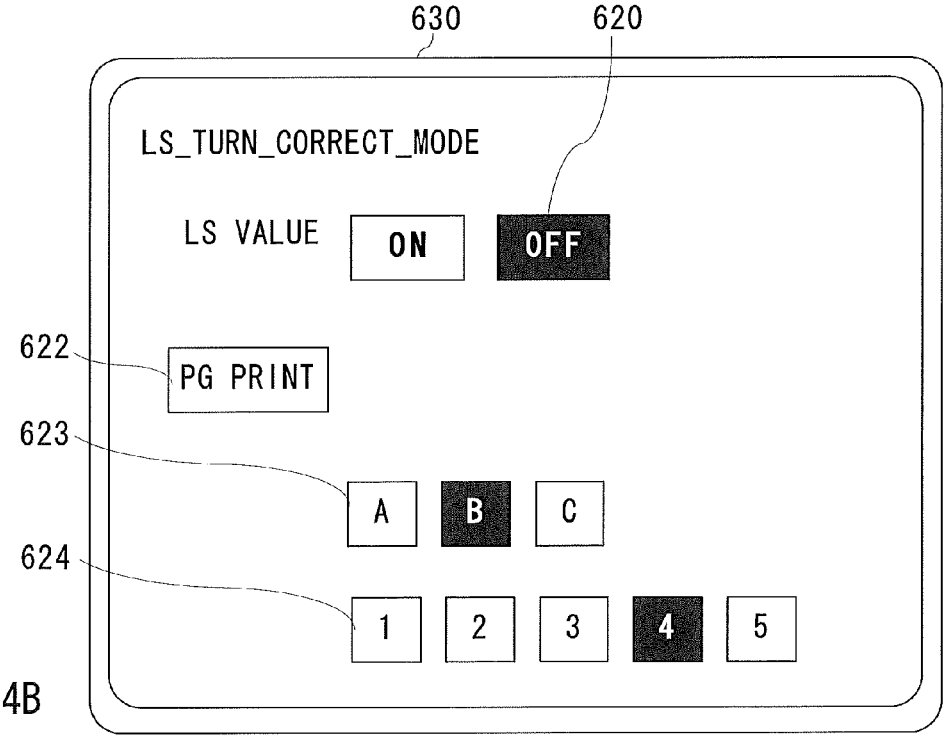

The operation unit 602 is described next. FIGS. 4A and 4B are diagrams illustrating an example of how an input screen of the operation unit 602 looks in optical facet angle error control. The input screen which is denoted by 630 is provided with an initial adjustment button 620 for choosing one from two options, specifically, "ON" and "OFF", an "execute test print" button 622 which is a push button, an axial error correction level button 623 for selecting one from three options, and an axial error correction phase button 624 for selecting one from five options. In FIGS. 4A and 4B, a button represented by white letters against a black background indicates that the button is selected, and a button represented by a dotted line indicates that selecting the button is prohibited.

When the image forming apparatus is initially shipped from the factory, the buttons are selected as displayed on the operation unit of FIG. 4A. Specifically, the initial adjustment button 620 is "ON" whereas selecting the "execute test print" button 622, the axial error correction level button 623, and the axial error correction phase button 624 is prohibited. When the initial adjustment button 620 is "OFF" as illustrated in FIG. 4B, on the other hand, selecting the "execute test print" button 622, the axial error correction level button 623, and the axial error correction phase button 624 is allowed.

Results of selection made by operating on the input screen 630 are written at an address "20" in the non-volatile memory 603. When the initial adjustment button 620 is "ON", "0" is written. When the initial adjustment button 620 is "OFF", the sum of a selection result of the axial error correction phase button 624 and a selection result of the axial error correction level button 623 is written. Selecting "A", "B", and "C" of the axial error correction level button 623 means that "5", "10", and "15" are respectively added to the written value. Selecting "1", "2", "3", "4", and "5" of the axial error correction phase button 624 means that "0", "1", "2", "3", and "4" are respectively added to the written value.

Figure 10:
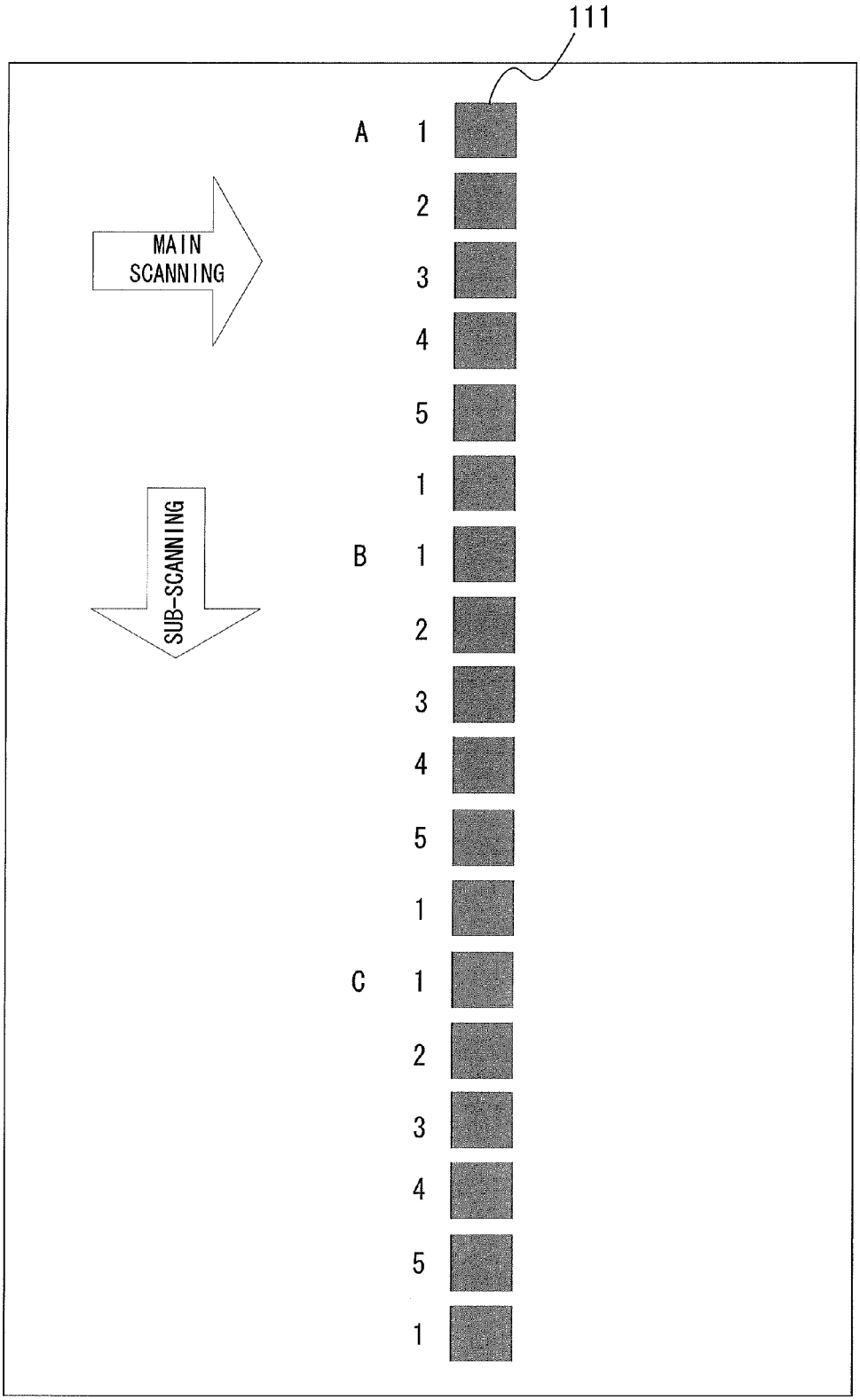
FIG. 10 is a diagram illustrating an example of a test print image.

In the example of FIG. 4B, 10+3="13" is written at the address "20". These values are used for processing of a corrected print mode, a test print mode, and the like in the image forming apparatus. The respective modes are described later.

[The Relation Between Optical Facet Angle Error and Density Unevenness]

Figure 5A:
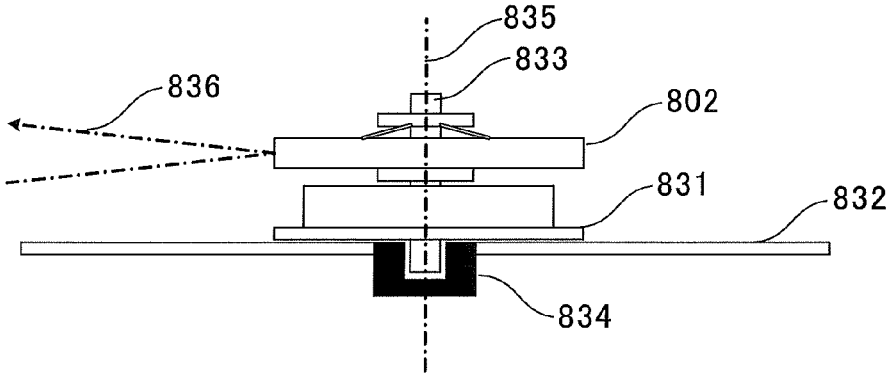
FIG. 5A is a schematic sectional view of a normal polygon mirror.
Figure 5B:
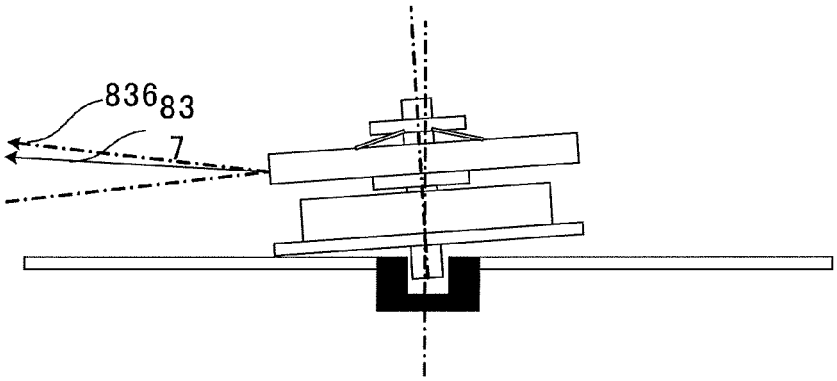
FIG. 5B is a schematic sectional view of a polygon mirror in which an optical facet angle error has occurred.
Figure 5C:
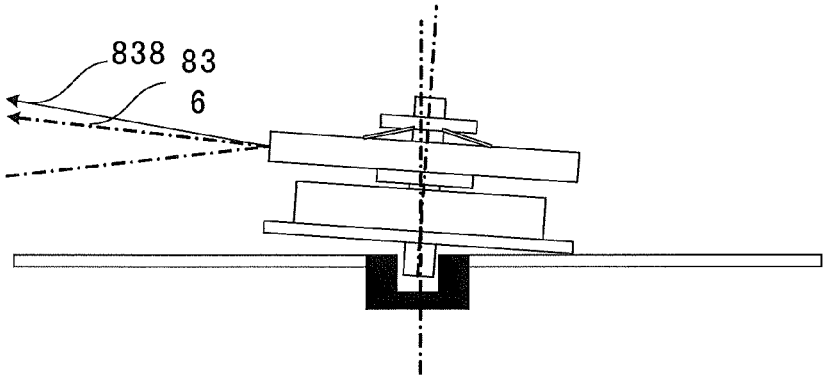
FIG. 5C is a schematic sectional view of another polygon mirror in which an optical facet angle error has occurred.

An optical facet angle error of the polygon mirror which is one of the causes of density unevenness is described next. FIG. 5A is a schematic sectional view of a normal polygon mirror. FIGS. 5B and 5C are each a schematic sectional view of a polygon mirror in which an optical facet angle error has occurred. A substrate 832 made of a metal material is fastened to an optical box of the LS unit 707 with a screw so that the posture of the DC brushless motor is held without being changed by vibrations or the like. A rotation axis 833, an outer rotor 831 of the DC brushless motor, and the polygon mirror 802 are fixed and fit into a bearing 834, and are thus positioned with respect to the optical box. In an image forming apparatus provided with a polygon mirror that has no optical facet angle error as illustrated in FIG. 5A, the rotation axis 833 forms an ideal angle along a reference line 835 (in this embodiment, the rotation axis and the reference line 835 are parallel to each other). In this case, laser light deflected by the polygon mirror is reflected along a light path 836, which is an ideal light path.

In an image forming apparatus provided with a polygon mirror that has an optical facet angle error, on the other hand, the rotation axis 833 and the reference line 835 are not parallel to each other as illustrated in FIG. 5B. In the image forming apparatus of the example of FIG. 5B, where the rotation axis 833 is tilted with respect to the reference line 835, laser light deflected by the polygon mirror deviates from the ideal light path 836 and takes a light path 837 illustrated in FIG. 5B. In the example of FIG. 5C, laser light takes a light path 838 which is deviated from the ideal light path 836. When such an optical facet angle error occurs, laser light is reflected by the five tilted planes of the polygon mirror one after another, resulting in density unevenness.

Figure 6:
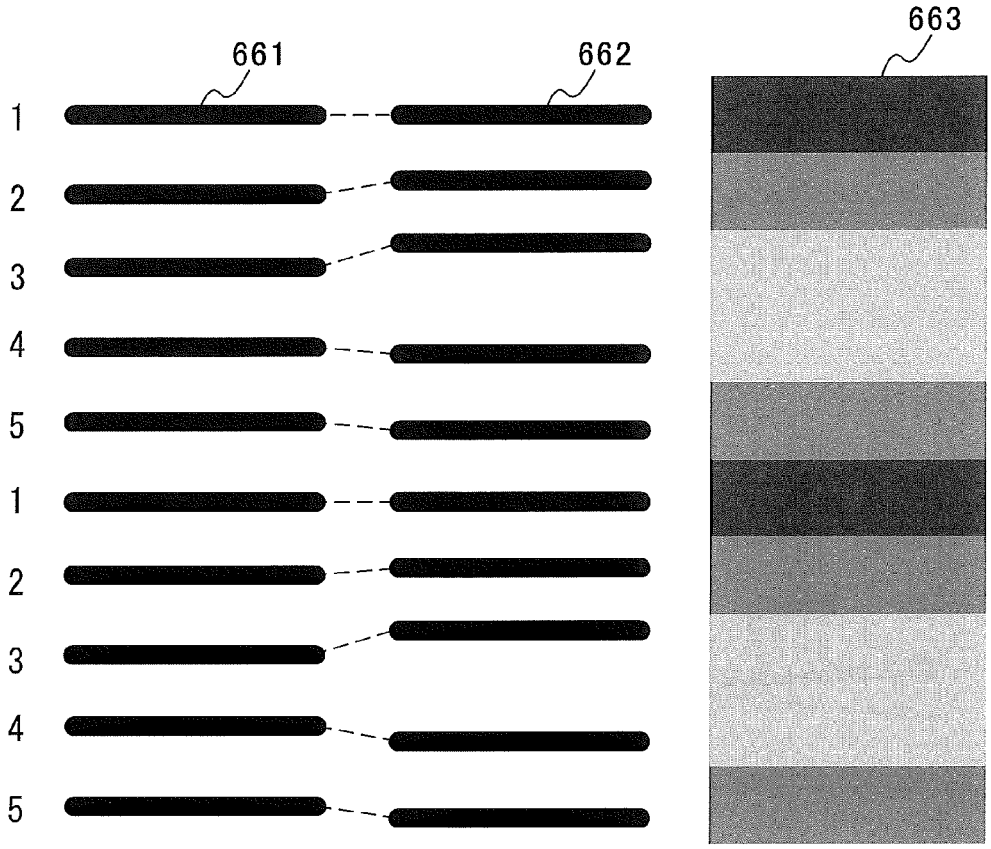
FIG. 6 is a conceptual diagram illustrating the relation between a scanning line cycle and image density unevenness.

Image density unevenness caused by an optical facet angle error is described next. FIG. 6 is a conceptual diagram illustrating the relation between a scanning line cycle and image density unevenness. A scanning line pattern 661 is the pattern of a correct scanning line cycle which is a cycle having five scanning lines. A scanning line pattern 662 is the pattern of the cycle disrupted by an optical facet angle error. An image 663 is an example of an image in which density unevenness is caused from the scanning line pattern 662. The amount of exposure per unit area is lower in a part of the scanning line pattern 662 where the interval between scanning lines is wider, and the corresponding part of the image 663 is therefore relatively lighter. On the other hand, a part of the pattern where scanning lines are close to one another makes the corresponding part of the image relatively dark. Density unevenness caused by an optical facet angle error can accordingly be corrected by, for example, adjusting the amount of exposure.

[Functions of the Image Forming Apparatus]

Figure 7:
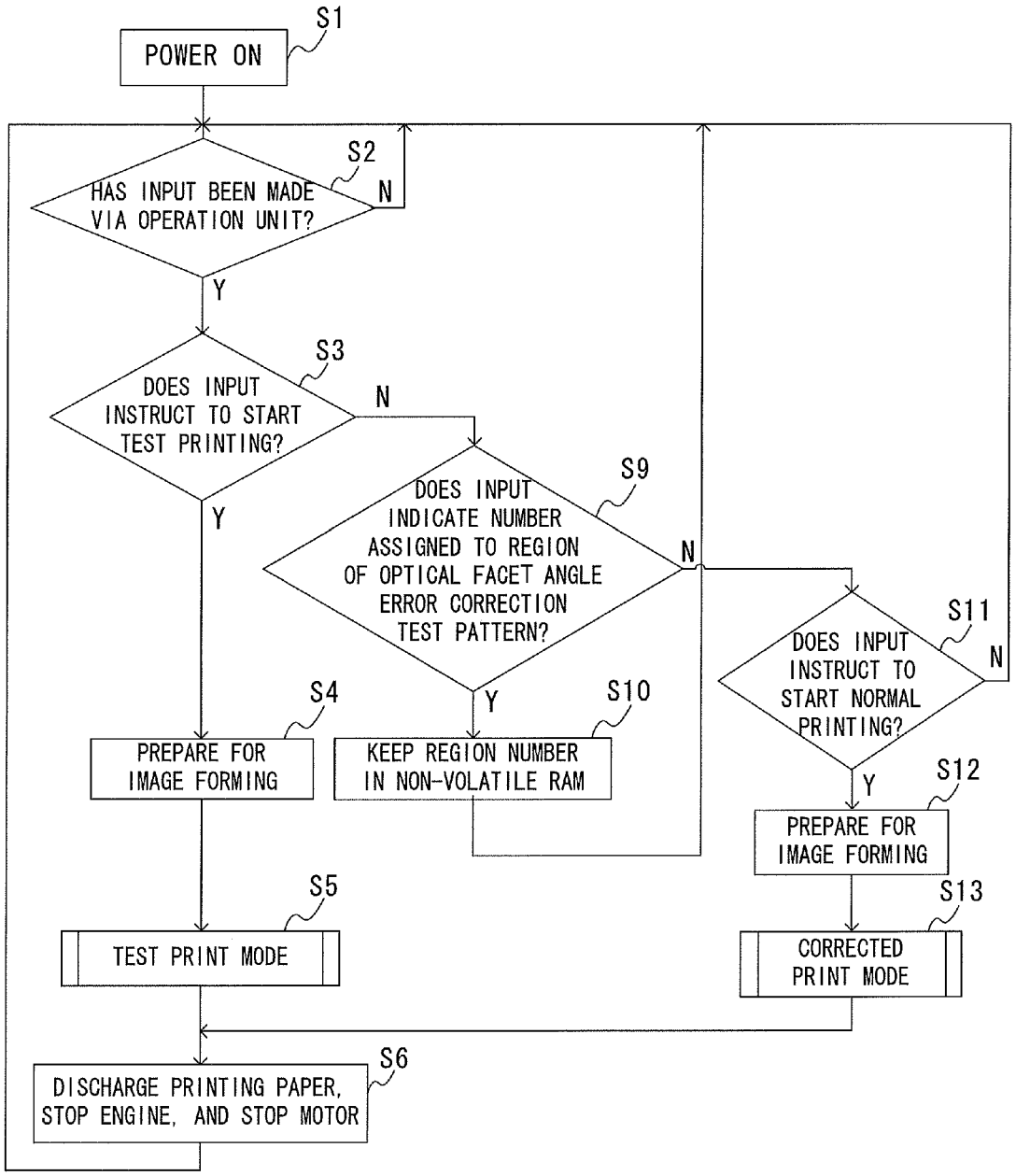
FIG. 7 is an overall flow chart for processing executed by a central processing unit (CPU).

Functions of the image forming apparatus 701 are described next with a focus on processing that is executed by the CPU 601. FIG. 7 is an overall flow chart for the processing executed by the CPU 601.

The overall flow chart is divided into three sequences, a first sequence, a second sequence, and a third sequence, by what is input from the operation unit. The first sequence is processing of executing test printing (Step S1→Step S2→Step S3→Step S4→Step S5).

The second sequence is processing of inputting optical facet angle error control information such as light amount correction data (Step S1→Step S2→Step S3→Step S9→Step S10).

The third sequence is processing of printing under optical facet angle error control such as light amount adjustment (Step S1→Step S2→Step S3→Step S9→Step S11→Step S12→Step S13).

For instance, the third sequence is executed when an input for normal printing is made from the operation unit. If density unevenness in the sub-scanning direction worsens while the image forming apparatus is in operation, the first sequence and the second sequence are executed to make a given adjustment by selecting to check or change how optical facet angle error control such as light amount adjustment is conducted. Input information about adjustment is kept in the non-volatile memory 603 in the second sequence, and then the second sequence is ended. The third sequence is executed after the adjustment. In the case of a small adjustment, optical facet angle error control that combines the three sequences may be selected.

[The Third Sequence]

The third sequence which is processing executed when a user uses normal printing is described first with reference to FIG. 7.

When the main body of the image forming apparatus is powered on (Step S1), the CPU 601 enters a state where the CPU 601 waits for an input from the user via the operation unit 602. The CPU 601 determines whether or not an input has been made from the operation unit 602 (Step S2). When it is determined in Step S2 that an input from the operation unit has been made (Step S2: Y), the CPU 601 determines whether or not the input is an instruction to start test printing (Step S3). When it is determined in Step S3 that the input is not an instruction to start test printing (Step S3: N), the CPU 601 determines whether the input is an input of a number assigned to a region of an optical facet angle error correction test pattern (Step S9). When it is determined in Step S9 that the input is not an input of a number assigned to a region of an optical facet angle error correction test pattern (Step S9: N), the CPU 601 determines whether or not the input is an instruction to start normal printing (Step S11). When it is determined in Step S11 that the input is an instruction to start normal printing (Step S11: Y), the CPU 601 starts preparation for forming an image (Step S12). In the image forming preparation, the CPU 601 starts driving components used in an electrophotography process. For instance, the motor of the polygon mirror 802 starts rotating in response to an instruction to start driving from the CPU 601. Light amount stabilizing control is also started in which the laser light source 808 is turned ON to adjust the amount of exposure. After the image forming preparation is finished, the CPU 601 next proceeds to a corrected print mode (Step S13).

Figure 8:
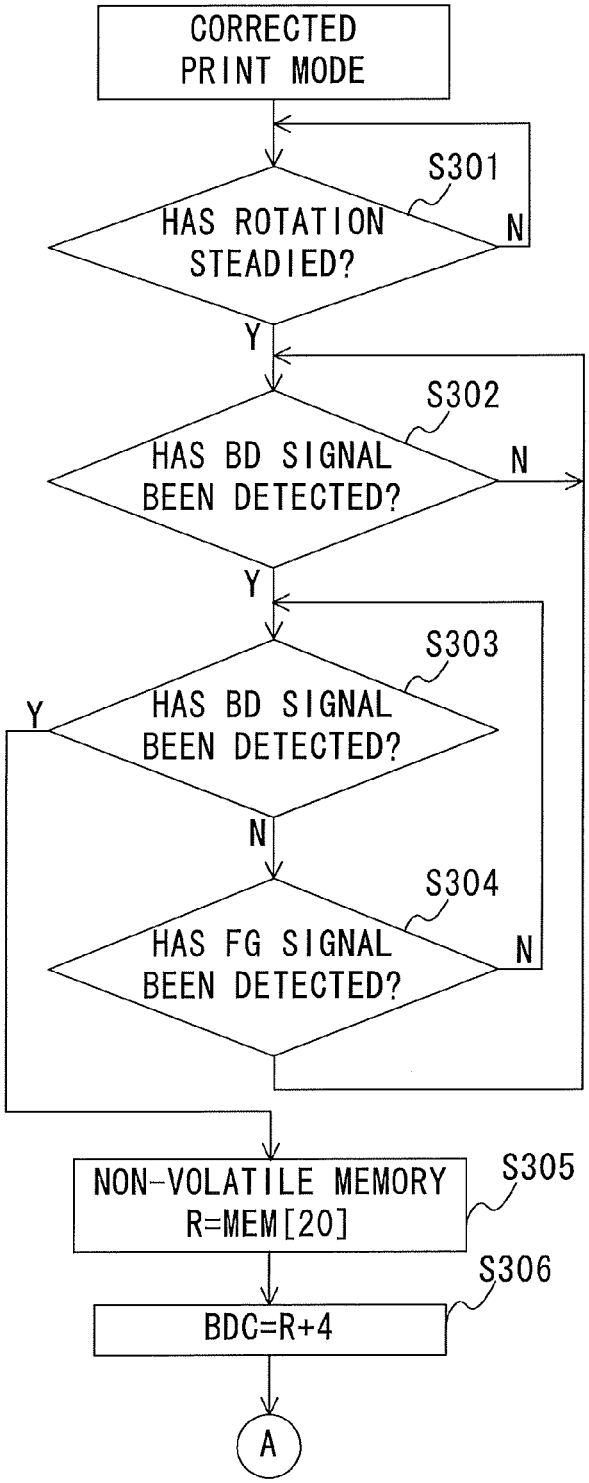
FIG. 8 is a flow chart for a corrected print mode.
Figure 9:
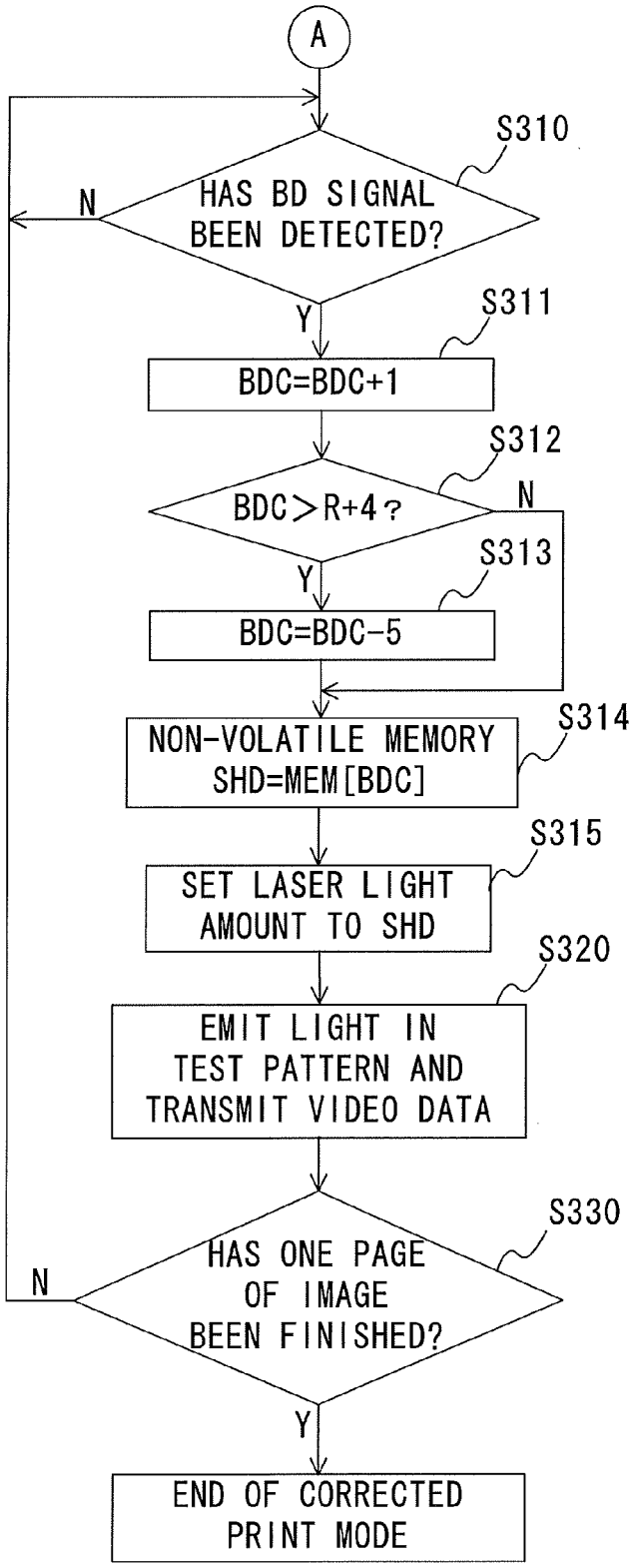
FIG. 9 is another flow chart for the corrected print mode.

Steps of the corrected print mode are illustrated in FIGS. 8 and 9. In the corrected print mode, the CPU 601 first starts processing of identifying one of the reflection planes of the polygon mirror as a reference plane.

Referring to FIG. 8, the CPU 601 determines whether or not the rotational speed of the motor has steadied based on the cycle of BD signals detected by the BD sensor 803 (Step S301). When the rotational speed of the polygon mirror steadies, a deflecting unit constituted of the polygon mirror which has five reflection planes and the driving motor which has a magnetic pole pattern with eight poles produces a five-pulse BD signal and a four-pulse FG signal in one rotation. Based on the status of the signal, e.g., rate or the like at which these signals are generated, the CPU 601 determines in Step S301 whether or not the rotational speed of the polygon mirror has steadied.

The CPU 601 next determines whether or not the BD sensor 803 has detected a BD signal (Step S302). When it is determined in Step S302 that a BD signal has been detected (Step S302: Y), the CPU 601 determines whether or not the second BD signal which follows the detected BD signal has been detected (Step S303). When it is determined in Step S303 that the second BD signal has been detected (Step S303: Y), the CPU 601 determines the polygon mirror plane that is in place at that point as a reference plane. In the case where two BD signals have not been detected in succession (Step S303: N) or in the case where the detection of an FG signal in the FG sensor 807 is interposed between the detection of one BD signal and another (Step S304: Y), detecting a BD signal is repeated.

Once the reference plane is identified, the optical facet angle error state is read out of the non-volatile memory 603 at the address "20" and is kept in an internal register of the CPU 601 (Step S305). Thereafter, "R+4" is copied to and kept in a "BD signal counter" (hereinafter abbreviated as BDC) of the internal register of the CPU 601 (Step S306).

Proceeding to FIG. 9, the CPU 601 waits for a further detection of a BD signal by the BD sensor 803 (Step S310). An image is drawn one scanning line by one scanning line in synchronization with the detection, thereby starting image forming. When a BD signal is detected (Step S310: Y), "+1" is counted as the BDC (Step S311). When the BDC subsequently exceeds "R+4" (Step S312: Y), the BDC value is reduced by 5 (="−5") (Step S313). Laser light is thus reflected by all reflection planes in one rotation of the motor, and the internal register functions as a current correction state register after the reference plane is identified.

The CPU 610 next selects a correction profile for a data value at an address that corresponds to the BDC value, and reads the selected profile out of the non-volatile memory 603 (Step S314). The correction profile is set as a light amount adjustment value (hereinafter referred to as SHD) (Step S315). For example, in the initial state where a value at the address "20" is "0", R=0 and BDC=0+4+1=5. Accordingly, BDC after Step S312 and Step S313 is 0. A value at an address "0", namely, "factory measured value light amount correction data 1" (hereinafter referred to as factory 1) is therefore read and output as a light amount adjustment value.

An image video data signal modulated by PWM modulation is transmitted to the light emitting unit 800 (the laser 808) in time with an image clock (not shown), which is synchronized with the detection of a BD signal, to thereby control the blinking of the laser 808 and draw a latent image.

The CPU 601 next determines whether or not drawing one page of image has been finished (Step S330). In the case where one page of image has not been finished and the next scanning line therefore needs to be drawn (Step S330: N), the CPU 601 returns to Step S310 to repeat the sequence for drawing an image one scanning line at a time. After one page is finished (Step S330: Y), the corrected print mode is ended.

According to the flow charts described above, the light amount of the first scanning line for drawing an image is set to "factory 1", the light amount of the next scanning line for drawing the image is set to "factory 2", and the light amounts of the subsequent scanning lines are set to "factory 3", "factory 4", and "factory 5", and then the cycle is repeated starting with "factory 1" and "factory 2". Thus, when the initial adjustment button is "ON", an image is formed with laser light in a light amount that is corrected for each reflection plane of the polygon mirror from "factory measured value light amount correction data 1" to "factory measured value light amount correction data 5".

[The First Sequence]

Figure 11:
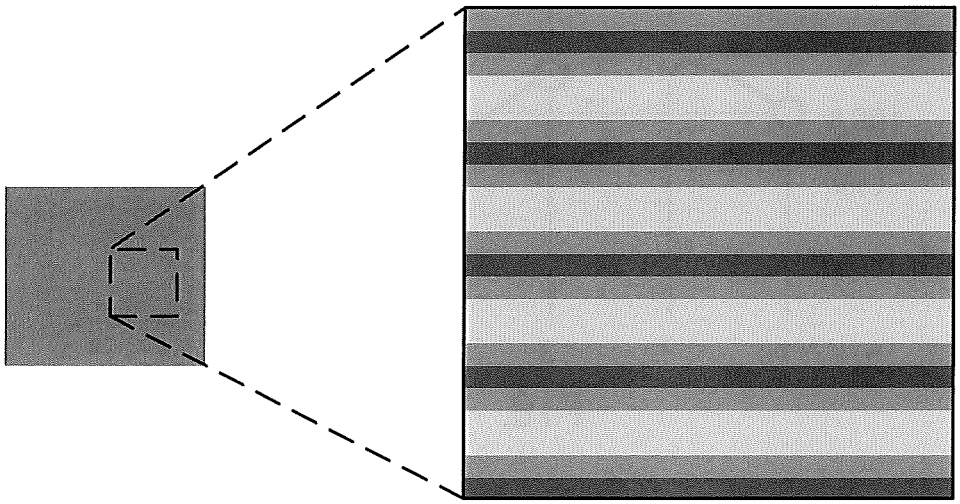
FIG. 11 is a diagram illustrating an example of an enlarged test pattern image.

The first sequence which allows the user to use test printing is described next. FIG. 10 is a diagram illustrating an example of a test print image which is output in the first sequence. FIG. 11 is a diagram illustrating an example of an enlarged test pattern image.

Eighteen 10-mm square regions labeled by symbols A, B, and C and numbers 1 to 5 are arranged in a test pattern 111. Image data in one region is of a light half tone image (hereinafter referred to as HT), and uses PWM data obtained at 30% lighting where density unevenness in the cycle of reflection plane is easily visible. While the eighteen regions have the same PWM data, the SHD differs from one of the eighteen regions to another, and behaves uniquely in each region.

When the test pattern 111 is viewed unaided, density unevenness in the cycle of motor rotation is hard to see in some cases and is seen in sharp contrast in other cases. The user compares the density unevenness on paper, and determines whether the current condition for optical facet angle error unevenness correction is appropriate or not. In order to facilitate this comparison, the whole test pattern 111 is placed as one line at the center of the photosensitive drum 708 in the main scanning direction where the image forming apparatus is influenced less by various causes for unevenness in the main scanning direction. The user compares fifteen types of patterns shown in the eighteen regions, identifies the number of one optimum region in which cyclic unevenness is least visible, and sets optimum light amount correction data via the operation unit 602.

Figure 12A:
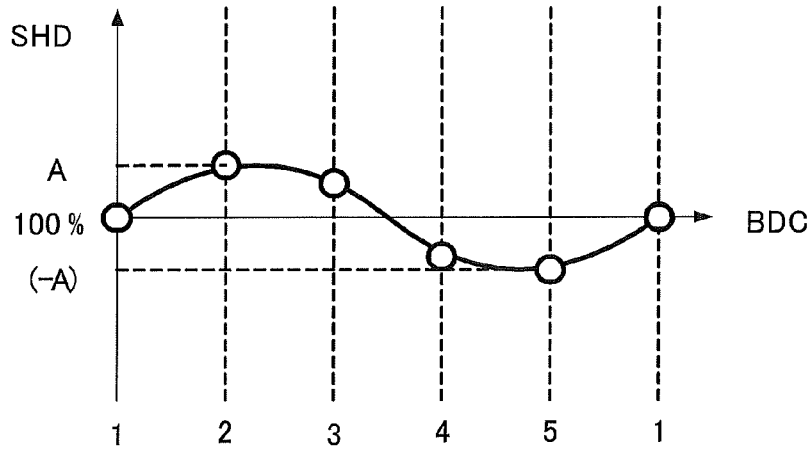
FIG. 12A is a diagram illustrating an example of a profile.

A profile used to correct density unevenness is described next. A sinusoidal correction profile is used in this embodiment. FIG. 12A is an example of a profile that is used for a test print image "A1" of FIG. 10. Each horizontal axis represents a reflection plane number and each vertical axis represents an SHD value. In the example of FIG. 12A, cyclic modulation having an amplitude A is performed on a 100% reference light amount.

One set of patterns is a sinusoidal light amount change in which five types of patterns constitute one cycle and which has the amplitude A. The five patterns are created by shifting the sinusoidal phase by 72 degrees at a time from plane identification information, and correspond to numbers 1 to 5. Here, the BDC associated with the reflection plane number 1 is 5, the BDC associated with the reflection plane number 2 is 6, and the same rule applies so that the reflection plane numbers 3, 4, and 5 are respectively associated with the BDC values 7, 8, and 9. Each BDC value is a piece of light amount modulation data.

Figure 12B:
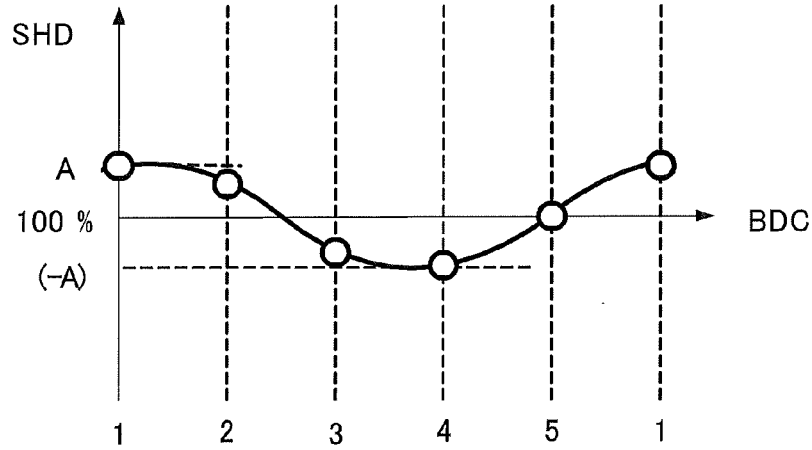
FIG. 12B is a diagram illustrating an example of another profile.
Figure 12C:
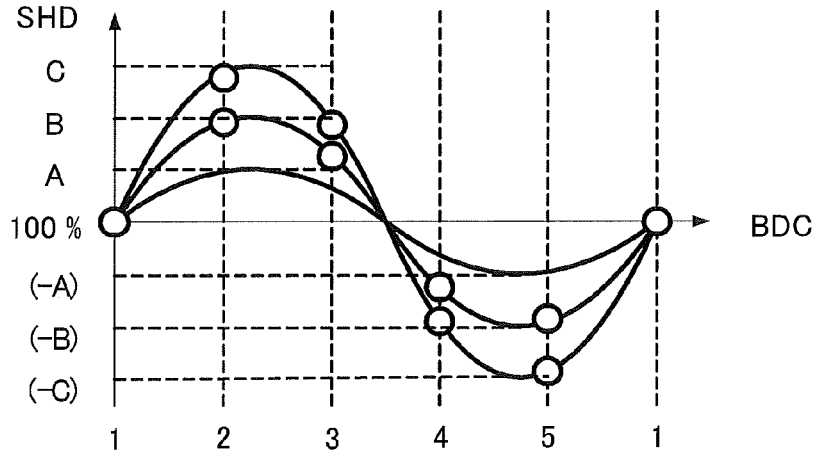
FIG. 12C is a diagram illustrating an example in which three profiles are overlaid on one another.

FIG. 12B is an example of a profile that is used for a test print image "A2" of FIG. 10. The phase of this profile is shifted by 72 degrees from the profile for "A1". The rule described above is applied and the reflection plane numbers 1, 2, 3, 4, and 5 are respectively associated with BDC values 6, 7, 8, 9, and 5 each of which is a piece of light amount modulation data. FIG. 12C illustrates an example in which profiles for "A1", "B1", and "C1" are overlaid on one another. Profiles "A", "B", and "C" differ from one another in sinusoidal amplitude. In the example of FIG. 12C, "C" has the largest amplitude.

The specifics of profiles recorded in the non-volatile memory 603 are described next with reference to FIG. 13. In FIG. 13, "factory measured value light amount correction data 1" to "factory measured value light amount correction data 5" are recorded as initial profiles at addresses "0" to "4" in the non-volatile memory 603. At addresses "5" to "9", "sinusoidal amplitude A light amount correction data 1" to "sinusoidal amplitude A light amount correction data 5" are recorded as profiles having an amplitude A=1%. At addresses "10" to "14", "sinusoidal amplitude B light amount correction data 1" to "sinusoidal amplitude B light amount correction data 5" are recorded as profiles having an amplitude B=2%. At addresses "15" to "19", "sinusoidal amplitude C light amount correction data 1" to "sinusoidal amplitude C light amount correction data 5" are recorded as profiles having an amplitude C=3%. Each profile is recorded in advance when the image forming apparatus is manufactured.

[The Generation of a Test Print Image]

Figure 14:
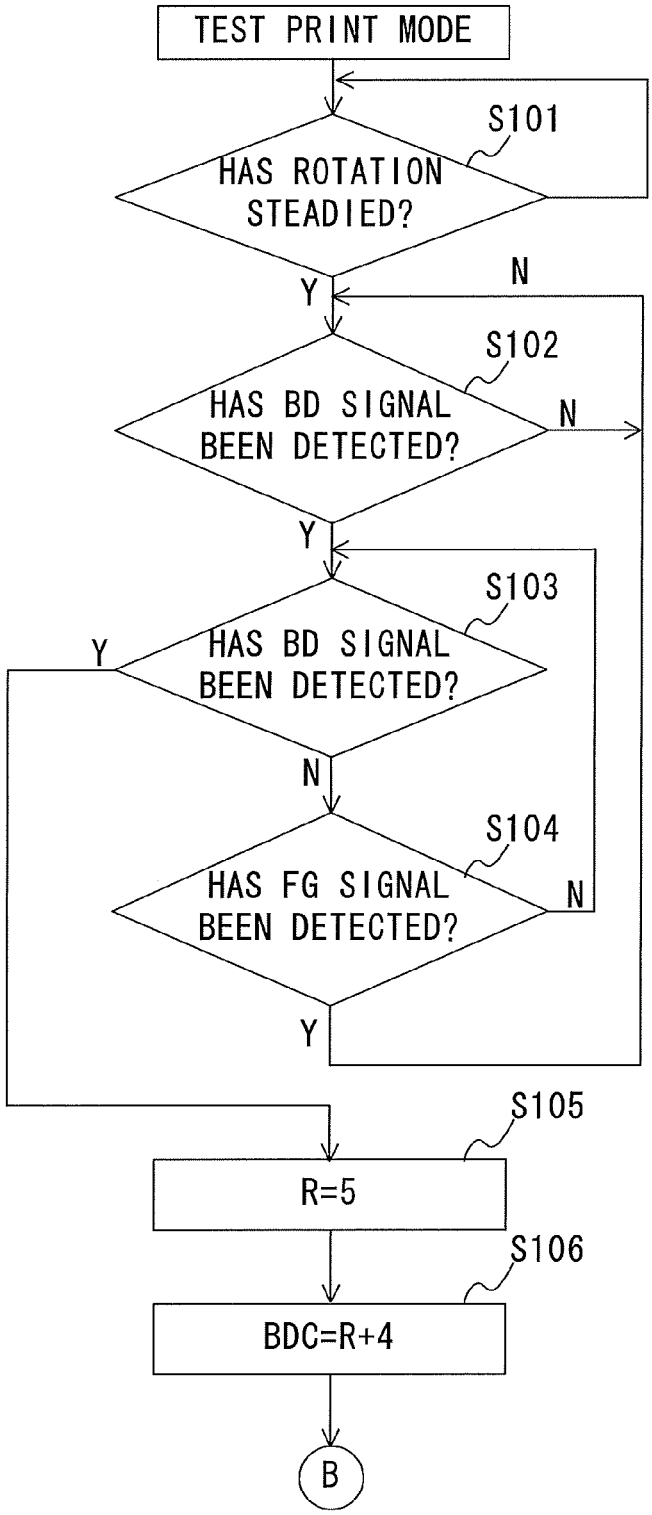
FIG. 14 is a flow chart for a test print mode.
Figure 15:
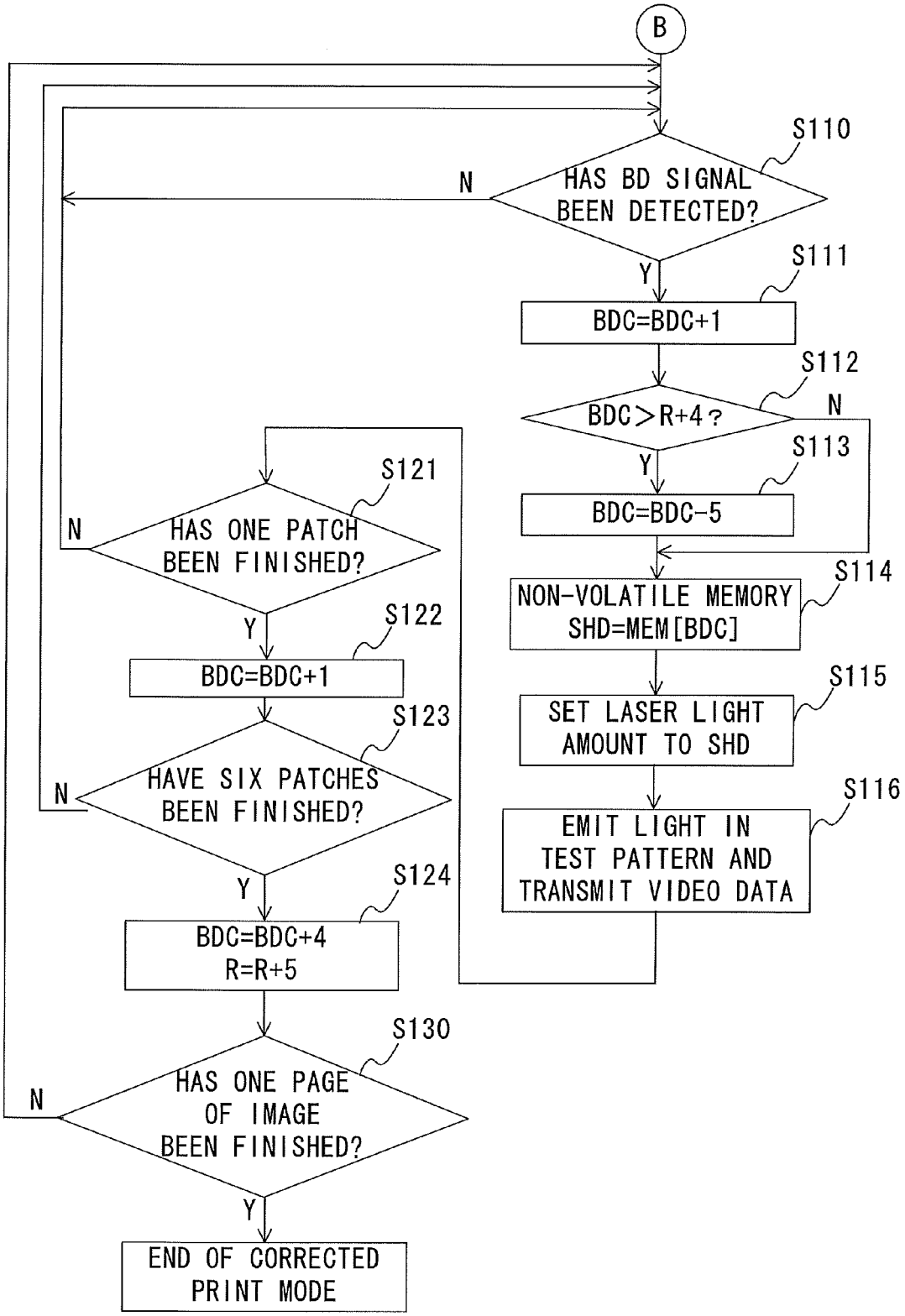
FIG. 15 is another flow chart for the test print mode.

An example of how the image forming apparatus 701 operates to generate a test print image is described next. FIGS. 14 and 15 are flow charts for a test print mode.

Also in the test print mode, a sequence for identifying the reference plane of the polygon mirror 802 is executed first (Step S101 to Step S104). This sequence is the same as the one in the corrected print mode, and a description thereof is omitted here.

After the reference plane of the polygon mirror 802 is identified, an initial value "5" is substituted in the internal register of the CPU 601 (Step S105), and "R+4" is copied to and held in the BDC (Step S106). The CPU 601 next waits for the detection of a BD signal by the BD sensor 803, and an image is drawn one scanning line at a time in synchronization with the detection, thereby starting image forming.

Proceeding to FIG. 15, the CPU 601 waits for a further detection of a BD signal by the BD sensor 803 (Step S110). An image is drawn one scanning line at a time in synchronization with the detection to start image forming. When a BD signal is detected (Step S110: Y), "+1" is counted as the BDC (Step S111). When the BDC exceeds "R+4" (Step S112: Y), the BDC value is reduced by 5 (="−5") (Step S113).

The first sequence, which is the test print mode, differs from the third sequence mode, which is the corrected print mode, in that the BDC functions as a register of a state associated with the current pattern number after the reference plane is identified. For instance, when R=5 and BDC=5+4+1=10, the BDC after Step S312 and Step 313 is 5.

A value at the address "5", namely, "sinusoidal amplitude A light amount correction data 1" (hereinafter referred to as AK1), is read and output as a light amount adjustment value.

The CPU 601 next selects a profile for a data value at an address that is associated with the BDC value, and reads the selected profile out of the non-volatile memory 603 (Step S114). The read profile is set as the SHD (Step S115).

An HT video data signal modulated by PWM modulation is transmitted to a laser element and the driving unit 800 in time with an image clock (not shown), which is synchronized with the detection of a BD signal. The HT video data signal is transmitted together with label video data by the side of the HT pattern and blank video data of a 10-mm pattern gap (Step S116), to control the blinking of the laser and draw a latent image.

The CPU 601 next determines whether or not one patch has been finished (Step S121). Specifically, the CPU 601 determines whether or not the final line of the pattern is less than 10 mm which corresponds to one side of one region. When the final line is less than 10 mm, the CPU 601 determines that one patch has not been finished (Step S121: N), and repeats a sequence for drawing an image one scanning line at a time.

The light amount of the first scanning line for drawing an image is set to "AK1", the light amount of the next scanning line for drawing the image is set to "AK2", and the light amounts of the subsequent scanning lines are set to "AK3", "AK4", and "AK5", and then the cycle is repeated starting with "AK1" and "AK2".

When the pattern gap becomes 10 mm or more and one patch is finished (Step S121: Y), the BDC is increased by 1 (="+1") (Step S122). This processing is repeated until six patches are finished (Step S123).

After a six-region image is generated, in other words, after six patches are finished (Step S123: Y), the BDC is increased by 4 (="+4") and the R is increased by 5 (="+5") in preparation for a switch to the next pattern set B1 (Step S124).

The final scanning line at this point is A1. Increasing the BDC and the R each by 5 (="+5") in Step S124 and Step S111 therefore means that the light amount of the next scanning line for drawing the image is "sinusoidal amplitude B light amount correction data 1" (hereinafter referred to as BK1). The light amount of the following scanning line for drawing the image is "BK2". The light amounts of the further subsequent scanning lines are set to "BK3", "BK4, and "BK5". The same processing is repeated by setting the light amounts to "BK1", "BK2" . . . . In this manner, the image drawing sequence is repeated for B1 and subsequent pattern sets until one page of image is finished (Step S130).

When the final line is drawn, thereby completing one page of image (Step S130: Y), the corrected print mode is ended.

Figure 16A:
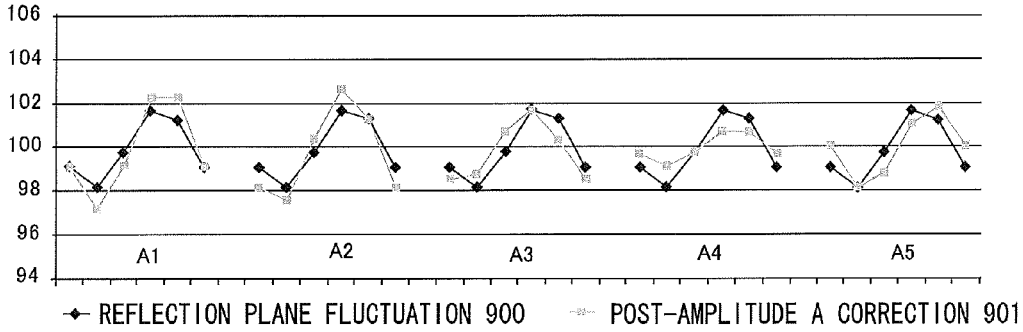
FIGS. 16A, 16B, and 16C are graphs showing results of visually determining a test pattern.
Figure 16B:
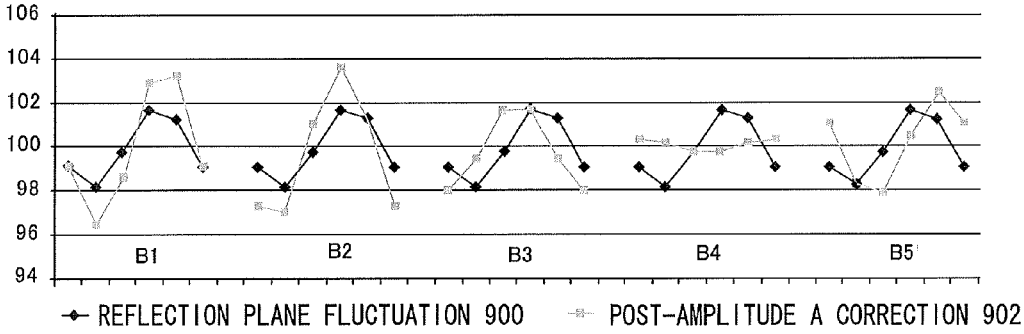
Figure 16C:
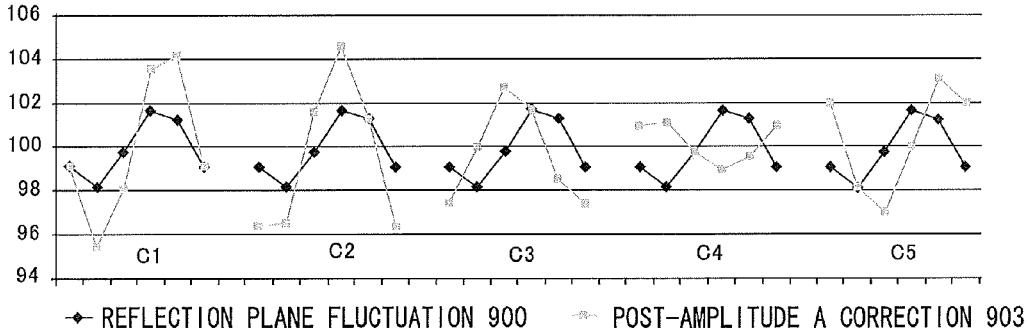

A utilization example of a test pattern obtained in the test print mode is described. FIGS. 16A to 16C are graphs showing results of visually determining the test pattern. In the graphs, the vertical axis has 100% as the scanning line density at the center, and horizontal axes indicate the cyclicity of density unevenness for each pattern region, and rotation unevenness phases which are associated with reflection plane numbers.

A reflection plane fluctuation line 900 represents cyclic unevenness that is observed when an optical facet angle error caused by an axial error occurs at a density amplitude of 1.86% and a density phase of 209 degrees (equivalent to 2.9 reflection planes). A post-amplitude A correction line 901, a post-amplitude B correction line 902, and a post-amplitude C correction line 903 represent the amplitudes and phases of corrected density unevenness that are observed after applying fifteen types of correction to the image forming apparatus. The phase of density unevenness cannot be sensed by visual determination whereas the amplitude can be sensed. In the graphs, density unevenness is small around B4 (A4, B3, B4, B5, and C4), particularly small in B4 (0.3% or less in this example). In patterns far from B4 (A1, B1, and C1), on the other hand, density unevenness is amplified and highlighted. A comparison against these patterns therefore allows the user to select the B4 line as a relatively optimum pattern.

The user follows through the decision to select B4 and executes the second sequence, which is processing of inputting optical facet angle error control information. Specifically, in the flow chart of FIG. 7, a number assigned to a region of an optical facet angle error correction test pattern is input (Step S9), and processing of keeping the input region number in the non-volatile memory 603 is executed (Step S10). For instance, the optical facet angle error control menu 630 is activated and "OFF" of the initial adjustment button 620 is selected as in the operation unit 602 of FIG. 4B. Thereafter, "B" of the axial error correction level button 623 and "4" of the axial error correction phase button 624 are selected. As a result, 10+3=13 is recorded in the non-volatile memory at the address "20" for the optical facet angle error correction mode state.

After an optical facet angle error adjustment is made, the third sequence is executed in which the user uses normal printing (Step S13). The CPU 601 reads R=13 at the address "20", which makes the BDC 13+4+1=18. Through the determination in Step S312 and Step S313, desired optical facet angle error control in which the BDC is 13 and "BK4" is at the head is reproduced. This corrects density unevenness and a print of improved image quality is easily obtained.

Thus, according to this embodiment, an optical facet angle error control in which an optimum light amount adjustment is made can be identified by checking a test pattern image generated by the first sequence, which is processing of the test print mode. The result of this identification is utilized in the third sequence for executing normal printing, which makes it possible to effectively correct density evenness after shipment.

Modification Example

While the first embodiment deals with an example that involves test printing, test printing may not be conducted. For instance, the user's burden regarding the work of correcting rotation cyclicity that has suddenly worsened can be lessened significantly just by adjusting optical facet angle error control information, without checking a test pattern image.

The function of correcting rotation cyclicity may be disabled by disabling initial adjustment with the initial adjustment button 620. A correction may also be made through a combination of the selection of the initial adjustment button 620, the selection of the axial error correction phase button 624, and the selection of the axial error correction level button 623.

In the first embodiment, sinusoidal profiles are used. Other rotation cyclicity profiles based on the characteristics of the polygon mirror 802 may be used instead. For instance, while the first embodiment shows, as a representative example, five sinusoidal correction profiles suited to the five reflection planes of the polygon mirror 802, the axial error angle does not always match the axes of the reflection planes of the polygon mirror 802. The number of profiles used for correction may be determined by the phase resolution of the profiles, and can be larger or smaller than the number of reflection planes of the polygon mirror, such as one fourth of a rotation or less or one sixth of a rotation or more. From the viewpoint of facilitating the designing of the optical system of the image forming apparatus 701, profiles suited to the number of reflection planes as in the first embodiment are optimum. In the case where higher correction performance is required, more profiles than the number of reflection planes of the polygon mirror 802 may be applied. For instance, the number of profiles can be an integral multiple of the number of reflection planes of the polygon mirror 802.

A diversity of printer functions are implemented in the first embodiment by a computer program that is read and executed by the CPU 601. The printer functions may be implemented by other pieces of hardware than the CPU 601 or by software, depending on the processing ability that can be used to implement the printer functions. For instance, a digital control unit can use a digital signal processor (DPS), or Application Specific Integrated Circuit (ASIC).

Various digital processing methods that are not limited to the first embodiment can thus be used in the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-101485, filed Apr. 26, 2012, which is hereby incorporated by reference herein in its entirety.

What is claimed is:

1. An image forming apparatus, comprising:

a photoreceptor;

a light source configured to emit a light beam based on image date for exposing the photoreceptor;

a rotating polygon mirror configured to deflect the light beam with a plurality of reflection planes so that the deflected light beam scans the photoreceptor, thereby to form an electrostatic latent image on the photoreceptor;

an image forming unit configured to develop the electrostatic latent image formed on the photoreceptor with a toner, and to transfer the developed toner image to a recording medium;

an identifying unit configured to identify one of the plurality of reflection planes to which the light beam emitted from the light source is incident;

a memory unit configured to store a plurality of pieces of control data for controlling the light amount of the light beam incident on the plurality of reflection planes of the polygon mirror to conform with the light amount corresponding to the reflection plane on which the light beam is entered, wherein each of the plurality of pieces of control data includes a plurality of correction data, and the light amount of the light beam, which is controlled for each of the reflection plane by the correction data, is sinusoidally changed with its one cycle corresponding to one rotation of the polygon mirror, wherein the sinusoidal changes of the light amount of the light beam, which is controlled by the plurality of pieces of control data in the one cycle, respectively have different phases, with one reflection plane of the plurality of reflection planes being a reference plane, and a control unit configured to control the light source and the image forming unit to form, by driving the light source based on each of the plurality of pieces of control data, a toner pattern image for detection corresponding to the plural pieces of control data.

2. An image forming apparatus according to claim 1, further comprising an operation unit configured to input processing information, wherein the control unit updates the at least one piece of light amount correction data stored in the memory unit based on the processing information which is input from the operation unit.

* * * * *